US005479841A

United States Patent [19]

Garrett

[11] Patent Number: 5,479,841

[45] Date of Patent: Jan. 2, 1996

[54] FREE STANDING MULTI-HARP HOLDER

[76] Inventor: Robert H. Garrett, 902 Green Valley Dr., St. Albans, W. Va. 25177

[21] Appl. No.: 125,800

[22] Filed: Sep. 24, 1993

[51] Int. Cl.[6] ..... G10D 7/12

[52] U.S. Cl. ..... 84/379; 224/910

[58] Field of Search ..... 84/379, 453; 224/910

[56] References Cited

U.S. PATENT DOCUMENTS

| | | | |
|---|---|---|---|
| 303,743 | 8/1884 | Murphy | 84/379 |
| 4,287,803 | 9/1983 | Zema | 84/379 |
| 4,397,213 | 8/1983 | Hubbard | 84/379 |

OTHER PUBLICATIONS

Harmonica Holder Found on p. 18 of Music Emporium Magazine Fall 91–Winter 92 Musicemporium USA 1150 Rockville Pike Rockville Maryland 20852.

*Primary Examiner*—Michael L. Gellner
*Assistant Examiner*—Cassandra C. Spyrou

[57] ABSTRACT

A free standing harmonica holder designed to fit onto a microphone stand thus leaving the musicians hands free to play other instruments. Consisting of a means to attach the unit to a microphone stand by the use of common microphone threads 94. A way to hold a standard microphone 12 by employing a U-bolt 96 and U-bolt nuts 63. A way to hold one or more harmonicas by means of harp holding plates 40 and compression springs 46. A means to quickly change from one harmonica to another by utilizing a pivot point 100 at the back end of the tapered sound chamber 20. A means of keeping the harmonica robe played in the desired relationship to the microphone by employing a mechanical locking device 75 consisting of a spring seat 70 mounted to the base 50 that holds a compression spring 72 and a locking head 74 that fits into notches 38 in the back of said tapered sound chamber head 20, also consisting of a means to keep said harmonica 98 in the desired relationship to the musician by employing a second pivot point 102 near the base.

4 Claims, 2 Drawing Sheets

FREE STANDING MULTI-HARP HOLDER

BACKGROUND—FIELD OF INVENTION

This invention relates to musical instrument holders and stands, specifically harp holders

BACKGROUND—DESCRIPTION OF PRIOR ART

Many, If not all harp players also enjoy playing other instruments. The problem arises when the musician wishes to play his harp and another instrument at the same time.

Heretofore, to the best of my knowledge, there has only been one product on the market that seeks to remedy this problem. It consists of a stiff wire that hangs around the musicians neck with a spring loaded holder that positions the harp in the musicians face thus freeing his/her hands for other instruments. Although it is true this does solve the problem it is not without its draw backs. For one thing it is constantly in the face and is uncomfortable to wear. It is also designed to accommodate only one harmonica and as any true harp player can tell you harmonicas come in different keys. If the musician wishes to play in another key he must fumble around and remove the harmonica that is in the holder and replace it with a harmonica of a different key. This is time consuming and not very practical in a live performance.

Most harp players, therefore, would find it desirable to have a harp holder that would free their hands, free them from wearing a wire yoke and give them a way to quickly change from one harp key to another.

OBJECTS AND ADVANTAGES

Accordingly I claim the following as my objects and advantages of the invention: to provide a holder that frees the user from the harmonica while still keeping the hands free to play other instruments whether it be guitar, piano, drums, etc.

In addition I claim the following additional objects and advantages: a means by which the harmonicas not only can be changed quickly and effortlessly, but changed so that with every change the harmonica in use is precisely lined up with the microphone as to allow for optimum sound fidelity.

Readers will find further objects and advantages of the invention from a consideration of the ensuing description and accompanying drawings.

DETAILED DESCRIPTION OF THE INVENTION

List of References Numerals

12 Microphones
20 Tapered Sound Chamber Head
22 Small Sound Chamber in 20
24 Plate
27 Left Hole in 24, 30, and 33
26 Right hole in 24, 30, an 33
28 Right Flared Sound Chamber Wall in 20
29 Left Flared Sound Chamber Wall in 20
30 Right Parallel Plate of 20

31 Top Sound Chamber Wall in 20
32 Left Parallel Plate of 20
33 Bottom Sound Chamber Wall in 20
34 Hole in 30
36 Hole in 32
38 Locking Notches in 32
40 Harp Holding Plate
42 Left Hole in 40
43 Right Hole in 40
44 Slot in 40
46 Compression Spring
48 Left Holding Pin
49 Right Holding Pin
50 Base
52 Right Wall of 50
54 Left Wall of 50
56 Front Wall of 50
58 Rear Wall of 50
60 Bottom of 50
62 Pivot Hole of 54
63 U-Bolt Nuts
64 Pivot Hole of 52
65 Lower Pivot Arm Mounting Hole
68 U-Bolt Hole in 60
69 U-Bolt
70 Spring Seat of 54
72 Compression Spring in 70
74 Locking Head in 70
75 Mechanical Locking Devise
76 Right Pivot Bolt
78 Left Pivot Bolt
80 Wing Nut for 76
82 Wing Nut for 78
84 Lower Pivot Arm
85 Connecting Holes of 84
86 Hole in 84
87 Upper Mounting Hole of 84
88 Stand Head
90 Hole in 88
91 Slot of 88
92 Pivot Fastener of 88
94 Standard Microphone Stand Threads in 88
95 Connecting Bolts
96 Connecting Nut
98 Harmonica
100 Tapered Sound Chamber Pivot Point
102 Second Pivot Point

Free Standing Multi-Harp Holder

Figure 1:
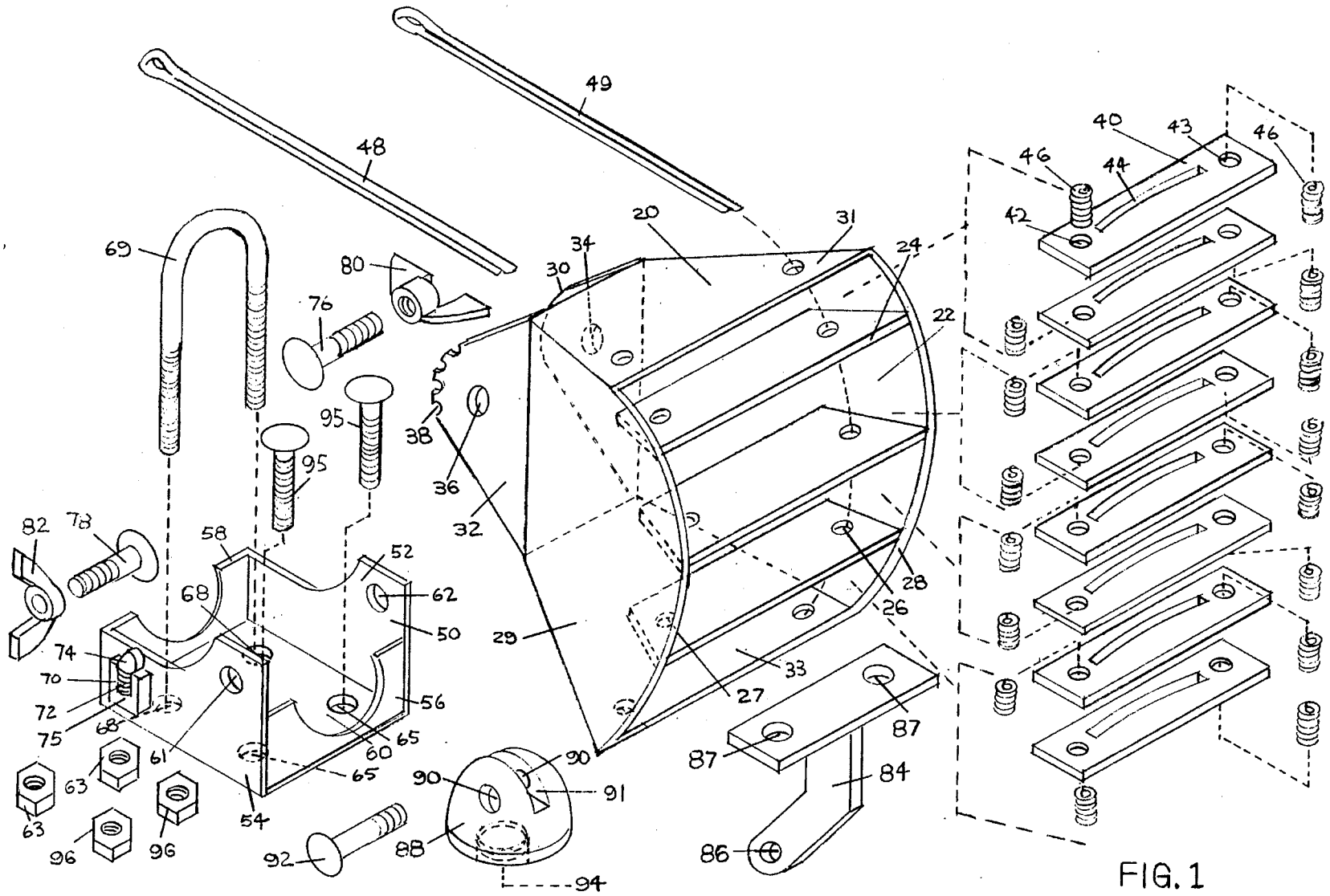
FIG. 1 is an exploded view of a presently preferred embodiment of the invention.

FIG. 1 shows the individual parts of the "Free Standing Multi-Harp Holder". The invention is comprised of a stand head 88 which has standard microphone stand threads 94 that screw on the shaft of any standard microphone stand (not shown). Said stand head 88 has a slot 91 and a hole 90 running through its upper half, the lower pivot arm 84 having a hole 86 in its lower end lines up in said slot 91 and said holes 90 lines up with said hole 86 and are connected by a pivot fastener 92. Said lower pivot arm is connected to the base 50 by connecting bolts 95 (2 each) passing through lower pivot arm mounting holes 65 (two each) and then through upper mounting holes 87 (two each) of said lower pivot arm 84, said connecting bolts 95 (2 each) secure above mentioned assembly by means of connecting nuts 96 (2 each). Said base 50 consists of a bottom 60, a right wall 52, a left wall 54, and a front wall 56. The spring seat 70 is mounted on said left wall 54. The compression spring 72 is seated in said spring seat 70. Locking head 74 is seated inside said compression spring 70. U-bolt 69 passes through U-bolt holes 68 (2 each). They are secured by U-bolt nuts 63 (2 each). They are used as a means of holding a standard microphone 12. Left pivot hole 64 lines up with hole 36 in the left parallel plate 32 and left pivot bolt 78 passes through above mentioned holes and is secured by wing nut 82. Right pivot hole 62 lines up with and hole 34 in the right parallel plate 30. Right pivot bolt 76 passes through above mentioned holes and is secured by wing nut 80. Plate 32 has locking notches 38 that work with said locking head 74 as a single locking mechanism. The flared head 20 consists of said left parallel plate 32, said right parallel plate 30, a right flared sound chamber wall 28, a left sound chamber wall 29, a top sound chamber wall 31, a bottom sound chamber wall 33, and several horizontal sound chamber plates 24, each having a left hole 27 and right hole 26. The harp holding plates 40 each have a right hole 43, a left hole 42 and a slot 44. The drawings show illustratively in flared head 20 four small sound chambers 22 and associated apparatus for holding four harmonicas. Starting at the top sound chamber 22, two of said holding plates 40 are assembled into the sound chamber 22 with a compression spring lined up with and below the right hole 43 in top sound chamber wall 31 and above the right holes 26 in a pair of harp holding plates 40. A compression spring 46 is also placed below said harp holding plates 40 and above the next lower horizontal sound chamber plate 24. The left side is lined up in a similar manner with the left hole 27 in top sound chamber wall 31 lining up with first said compression spring 46, then said left holes 42 (two each) of said harp holding plates 40, then a second said compression spring 46, then the left hole 27 of said lower harp holding plate. This assembly is repeated in every sound chamber 22. The lined up springs and harp holding plates 40 are held into place by passing the left holding pin 48 through the above mentioned lined up springs and holes in the left and passing the right holding pin 49 through the above mentioned springs and holes on the right. Said harp holding plates are then pried apart and a harmonica is inserted between the two harp holding plates 40 by the pressure created by said compression springs 46.

Free Standing Multi-Harp Holder—Operation

Figure 2:
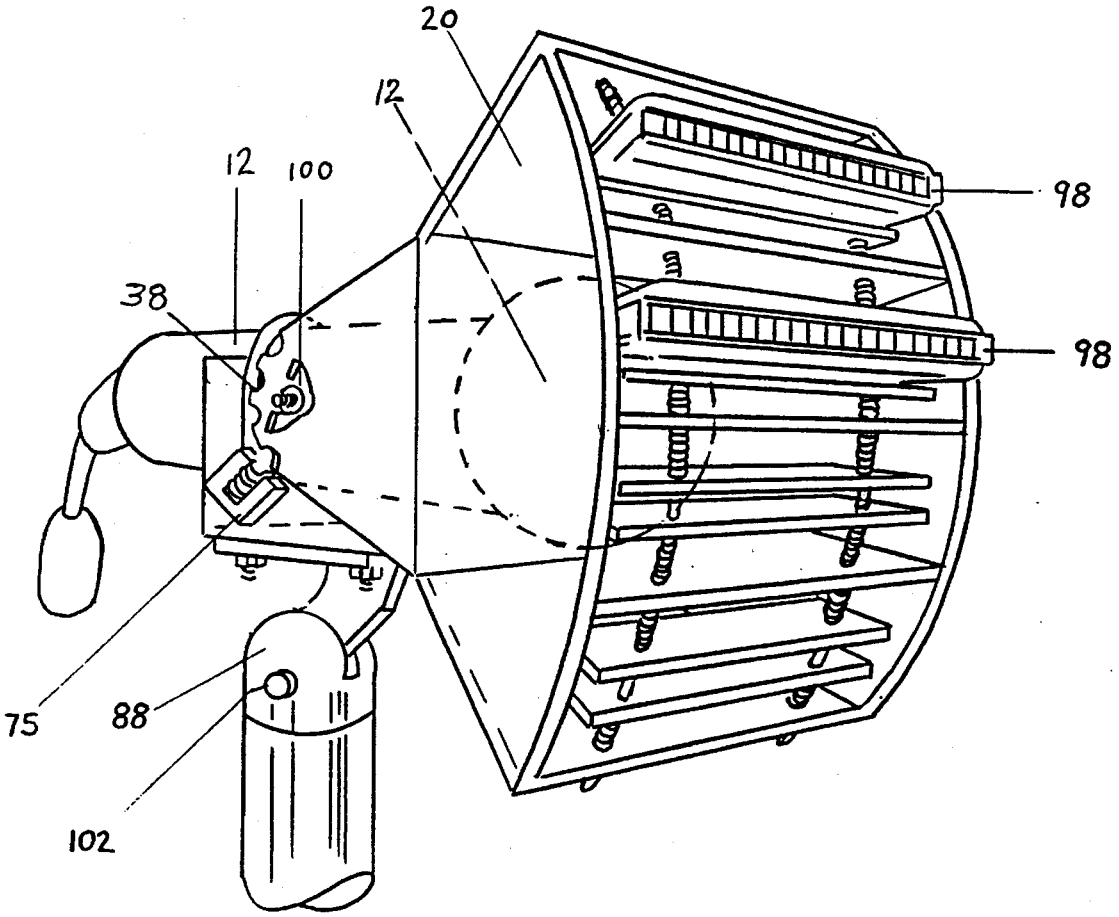
FIG. 2 is a perspective view of the apparatus of FIG. 1.

The free standing Multi-Harp Holder as shown in FIG. 2 will hold several harmonicas by means of spring loaded clamping plates 40 (see FIG. 1). The harp holder has two pivot points 100 and 102 (shown on FIG. 2) that allows the harmonicas to be rotated to the proper angle for playing. Rotation point 100 allows the harmonicas to be positioned in the same relationship with the microphone in each of the different settings for optimum sound fidelity. The notch 38 and spring loaded locking head 74 system allows the flared head 20 to be rotated to fixed points around a standard microphone and stopped at a aligned position each time. The microphone is held in place by U-bolt 69 and U-bolt nuts 63. Although FIG. 2 shows a model designed to accommodate four harmonicas, it is also possible to extend the flared head 20 around 360 degrees and thus accommodate many more harmonicas.

Conclusion, Ramification and Scope of Invention

The reader will see that the Free Standing Multi-Harp Holder will provide to all musicians who ever sought to play a harmonica and another instrument simultaneously in a performance, the freedom to move around on stage unhindered by a wire yoke. A means to change from one key to another with speed and ease. A means to adjust the harp to the proper playing angle and still keep it in line with a microphone for maximum sound quality.

While my above description contains many specificities, these should not be construed as limitations on the scope of the invention, but rather as an exemplification of one preferred embodiment thereof. Many other variations are possible.

I claim:

1. Apparatus for simultaneously holding a plurality of harmonicas comprising a walled base defining an enclosure, a microphone extending through a rear portion of said base into said enclosure, a flared sound chamber disposed around portions of said base and said microphone, a plurality of transverse sound chamber plates disposed at the periphery of said sound chamber arid forming a plurality of small sound chambers, a pair of transverse, spring biased holding plates disposed in each of the small sound chambers and adapted to hold a harmonica therebetween, pivot means to pivot said flared chamber about an axis perpendicular to the axis of said microphone so that a harmonica to be played in any of said small sound chambers may be pivoted to desired position adjacent the end of said microphone, locking means to lock said flared sound chamber in desired position comprising a plurality of notches provided in a wall portion of said flared sound chamber, and a spring loaded locking member disposed on said base and engaging within one of said notches.

2. Apparatus according to claim 1, further comprising microphone stand, and second pivot means connecting said base and said microphone to said microphone stand.

3. Apparatus according to claim 1, further comprising a compression spring positioned adjacent each end of said holding plates to spring bias same, each said compression spring having one end engaging a respective one of said holding plates and having another end of each said spring attached to an adjacent one of said sound chamber plates.

4. Apparatus for simultaneously holding a plurality of harmonicas comprising a walled base defining an enclosure, a flared sound chamber connected to said base, a microphone extending through a rear portion of said base into said sound chamber, means disposed at the periphery of said sound chamber for forming a plurality of small sound chambers, spring biased means disposed in each of said small sound chambers to hold a harmonica, pivot means to pivot said flared sound chamber about an axis perpendicular to a central axis of said microphone so that a harmonica to be played in any of said small sound chambers may be pivoted to a playing position adjacent an end of said microphone, and locking means to lock said flared sound chamber in desired position comprising a plurality of notches provided in a wall portion of said flared sound chamber, and a spring loaded locking member disposed on said base engaging within a respective one of said notches.

* * * * *